US006683409B2

(12) United States Patent
Mikami et al.

(10) Patent No.: US 6,683,409 B2
(45) Date of Patent: Jan. 27, 2004

(54) STRUCTURED LIGHTING MATERIAL, METHOD TO GENERATE INCOHERENT LUMINESCENCE AND ILLUMINATOR

(75) Inventors: Masayoshi Mikami, Kanagawa (JP); Hajime Yamamoto, Tokyo (JP); Shinichiro Nakamura, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 10/033,047

(22) Filed: Dec. 27, 2001

(65) Prior Publication Data

US 2002/0079824 A1 Jun. 27, 2002

(30) Foreign Application Priority Data

Dec. 27, 2000 (JP) ..... 2000-397494

(51) Int. Cl.[7] ..... H01J 1/62

(52) U.S. Cl. ..... 313/503; 313/486; 313/496; 313/461; 257/10

(58) Field of Search ..... 313/486, 503, 313/496, 461; 257/10

(56) References Cited

U.S. PATENT DOCUMENTS 3,643,092 A * 2/1972 van der Feyst ..... 250/486.1

5,637,958 A * 6/1997 Levine ..... 313/496

FOREIGN PATENT DOCUMENTS

| | | |
|---|---|---|
| JP | 62-35447 | 2/1987 |
| JP | 08-283713 | 10/1996 |
| JP | 10-121041 | 5/1998 |
| JP | 10-121043 | 5/1998 |

OTHER PUBLICATIONS

"Phosphor Handbook" by Shigeo Shinonoya, et al. 1998.

* cited by examiner

*Primary Examiner*—Jerome Jackson
(74) *Attorney, Agent, or Firm*—Katten Muchin Zavis Rosenman

(57) ABSTRACT

A structured lighting material, an illuminator, and the method to generate incoherent luminescence wherein luminescent intensity increases superlinearly when excitation energy applied thereto through electron beam, electric charge, electric field or the like exceeds a threshold. In the present invention, the structured lighting material is easily made to have a minute uneven surface. This invention enables high-efficient lighting devices, sensors and memories owing to the superlinearity.

17 Claims, 10 Drawing Sheets

STRUCTURED LIGHTING MATERIAL, METHOD TO GENERATE INCOHERENT LUMINESCENCE AND ILLUMINATOR

BACKGROUND OF THE INVENTION

1) Field of the Invention

The present invention relates to a structured lighting material, a method to generate incoherent luminescence employing the structured lighting material, and an illuminator comprising the structured lighting material which emits light when energy is externally applied thereto.

2) Description of the Related Art

To date, various luminescent devices have been developed which emit light in response to energy being externally applied thereto (for example, using an electron beam). Such luminescent devices have come into widespread use in display applications using a cathode-ray tube, a projection tube or the like (ef. Phosphor Handbook, by S. Shionoya and W. M. Chen, CRC Press, Boca Raton, Fla., 1998). The present invention concerns a specific structured lighting material to be used in a luminescent device as described below.

A description will be given hereinbelow of a conventional luminescent device with reference to FIGS. 11(A) and 11(B). A luminescent device comprises a metal-made substrate (base) 102 and a luminescent unit 103 made by placing a phosphor on the substrate 102 in the form of a layer.

In such a configuration, the luminescent device emits light when the host of a phosphor constituting the luminescent unit 103 is excited by electric energy such as electron beam, electric charge or electric field applied from the external. Thus, the luminescent device can convert the inputted electric energy (excitation energy) into luminescence to be outputted.

Although the luminescence or emission intensity of the luminescent device generally increases monotonically with an increase in an excitation energy inputted from the external, the degree of increase is prone to drop if the excitation energy quantity exceeds an energy quantity; if the excitation energy quantity further increases, the luminescent intensity reaches a saturation or decreases (cf. Phosphor Handbook, by S. Shionoya and W. M. Yen, CRC Press, Boca Raton, Fla., 1998, p.489–p.498). When a correlation between electron beam current (current value) A acting as excitation energy and luminescence intensity are shown on a log-log graph and the inclination (which will be referred to hereinafter as an "input-output differential variation") $\theta[=\Delta \log(I)/\Delta \log(A)]$ of the line representing this correlation assumes a positive value, it is referred to as a monotonic increase.

The input-output differential variation of the conventional luminescent device is apt to get worse as the input energy such as electron beam increases.

SUMMARY OF THE INVENTION

The present invention has been developed in consideration of such a situation, and it is therefore an object of the invention to provide a structured lighting material wherein luminescent intensity increases superlinearly when excitation energy based on electron beam, electric charge or electric field exceeds a threshold.

In the present invention, the term "superlinearly" signifies that the input-output differential variation $\theta$ increases when applied energy exceeds a threshold. In most cases, when the applied energy is below the threshold, the input-output differential variation $\theta$ assumes less than 1. On the other hand, it becomes 1 or more when the applied energy is above the threshold.

For this purpose, a structured lighting material according to the first aspect of the present invention is characterized by comprising a luminescent unit wherein the intensity of incoherent luminescence increases superlinearly when energy applied in a non-contact manner exceeds a threshold.

This arrangement, wherein the luminescent intensity of the luminescent unit increases superlinearly when the electric energy given in a non-contact manner exceeds the threshold, can be incorporated into a wide range of applications. For example, the application to various types of illuminations is feasible owing to its high-efficient luminescence. As a further advantage, it is also applicable to detection equipment, alarm equipment or the like because the magnitude of the electric energy can be monitored from the luminescence intensity of the luminescent unit. Furthermore, the application to memories or various types of control devices becomes feasible because the luminescent intensity varies rapidly around a threshold so that the variation of the luminescent intensity is extracted as on/off signals in a state where reference is set to the threshold.

In accordance with a further feature of the present invention, in the structured lighting material stated above as the first aspect of the invention, the luminescent color of the luminescent unit varies as the input energy increased beyond the threshold.

This provides easy visual confirmation of the variation of the state of the luminescent unit.

In accordance with a further feature of the present invention, in the structured lighting material stated above as the first aspect of the invention, the energy is electric energy originating from any one of electron beam, electric charge and electric field.

This allows an energy applying means in a conventional structured lighting material (such as a conventional luminescent device) to be available as it is.

In accordance with a further feature of the present invention, in the structured lighting material stated above as the first aspect of the invention, the luminescent part has a non-electrical conductive property.

This can provide advantages of securing electrification property of the luminescent unit, generating rapid increase of the luminescent intensity beyond a threshold and effective variation of luminescent color, and developing such variation in the intensity and color of the luminescent unit with low applied energy.

A structured lighting material according to the second aspect of the present invention is characterized by comprising a luminescent unit which shows a non-electrical conductive property and has a microscopic or minute uneven surface, wherein the luminescent intensity increases superlinearly when energy applied to the minute uneven surface in a non-contact manner exceeds a threshold.

The effects similar to those of the structured lighting material according to the first aspect of the invention are attainable, because the luminescent intensity of the luminescent unit increases superlinearly and the luminescent color of the luminescent part varies, when electric energy applied to the minute uneven surface in a non-contact manner exceeds the threshold.

In addition, the luminescent intensity higher than that of a conventional structured lighting material is assured, which realize a high-output illuminator.

Still additionally, the requirement for the luminescent unit is only the realization of the minute uneven surface, and various kinds of knowledge concerned with the conventional structured lighting materials can be put directly to practical use.

In accordance with a further feature of the present invention, in the structured lighting material stated above as the second aspect of the invention, the minute uneven surface is formed in a manner that the thickness of the luminescent unit is made non-uniform.

This allows easy formation of the minute uneven surface simply by making the thickness of the luminescent unit non-uniform. The effects similar to those of the structured lighting material according to the second aspect of the invention are attainable.

In accordance with a further feature of the present invention, in the structured lighting material stated above as the second aspect of the invention, the minute uneven surface has high and low portions respectively corresponding to maximum and minimum thicknesses of the luminescent unit, and the maximum thickness is set to be three or more times said minimum thickness.

This makes the unevenness of the luminescent unit surface effective, and the effects similar to those of the above-mentioned structured lighting material is assured.

In addition, in accordance with a further feature of the present invention, in the structured lighting material stated above as the second aspect of the invention, the minute uneven surface has high and low portions respectively corresponding to maximum and minimum thicknesses of the luminescent unit, and the maximum thickness is set to be ten or more times said minimum thickness.

This makes the unevenness of the luminescent unit surface effective, and the effects similar to those of the above-mentioned structured lighting material is more assured.

Still additionally, in accordance with a further feature of the present invention, in the structured lighting material stated above as the second aspect of the invention, the minimum thickness of the luminescent unit is not more than 500 $\mu$m.

This makes the unevenness of the luminescent unit surface effective, and the effects similar to those of the above-mentioned structured lighting material is assured.

Furthermore, in accordance with a further feature of the present invention, in the structured lighting material stated above as the second aspect of the invention, the minimum thickness of the luminescent unit is not more than 50 $\mu$m.

This makes the unevenness of the luminescent unit surface effective, and the effects similar to those of the above-mentioned structured lighting material is more assured.

Still moreover, in accordance with a further feature of the present invention, in the structured lighting material stated above as the second aspect of the invention, an inclination angle (slope angle) of an uneven surface of a local site is in a range from 30 degrees to 150 degrees.

This makes the unevenness of the luminescent unit surface effective, and the effects similar to those of the above-mentioned structured lighting material is assured.

Yet moreover, in accordance with a further feature of the present invention, in the structured lighting material stated above as the second aspect of the invention, an inclination angle of an uneven surface of a local site is in a range from 50 degrees to 130 degrees.

This makes the unevenness of the luminescent unit surface effective, and the effects similar to those of the above-mentioned structured lighting material is more assured.

Furthermore, in accordance with a further feature of the present invention, in the structured lighting material stated above as the first aspect of the invention, the luminescent unit is made of inorganic material.

Accordingly, this realizes less degradation while the energy is applied thereto.

Still furthermore, in accordance with a further feature of the present invention, in the structured lighting material stated above as the first aspect of the invention, the luminescent unit is adhered on a substrate.

This allows the luminescent unit to be formed in a stable condition.

Yet furthermore, in accordance with a further feature of the present invention, in the structured lighting material stated above as the first aspect of the invention, the luminescent unit is adhered on a substrate without using water-soluble fixing agent.

This secures the electrification property of the luminescent unit, and the effects similar to those of the above-mentioned structured lighting material are attainable.

Moreover, in accordance with a further feature of the present invention, in the structured lighting material stated above as the first aspect of the invention, the luminescent unit is adhered on the substrate in a manner of facilitating electrification.

This secures the electrification property of the luminescent unit. The effects similar to those of the above-mentioned structured lighting material are attainable.

Still moreover, an illuminator according to the third aspect of the present invention is characterized by comprising the structured lighting material according to the first or second aspects of the present invention.

This provides efficient luminescence for supplied energy.

In addition, a method to generate incoherent luminescence according to the fourth aspect of the present invention is characterized by applying energy more than a threshold to the structured lighting material including a luminescent unit wherein the intensity of incoherent luminescence increases superlinearly when energy applied in a non-contact manner exceeds the threshold.

This offers the effects similar to those of the structured lighting materials according to the first and second aspects of the present invention.

BRIEF DESCRIPTION OF THE DRAWINGS

FIG. 1(A) is an illustrative plan view while FIG. 1(B) is an illustrative enlarged cross-sectional view taken along a line X1—X1 of FIG. 1(A);

FIG. 2(A) is an illustrative plan view while FIG. 2(B) is an illustrative enlarged cross-sectional view taken along a line X3—X3 of FIG. 2(A);

FIG. 10(A) is an illustrative cross-sectional view while FIG. 10(B) is an illustrative view showing a cross section perpendicular to a cross section of FIG. 10(A); FIG. 11(A) is an illustrative plan view while FIG. 11(B) is an illustrative cross-sectional view taken along a line X2—X2 of FIG. 11(A).

DESCRIPTION OF THE PREFERRED EMBODIMENTS

Embodiments of the present invention will be described hereinbelow with reference to the drawings.

Figure 1:
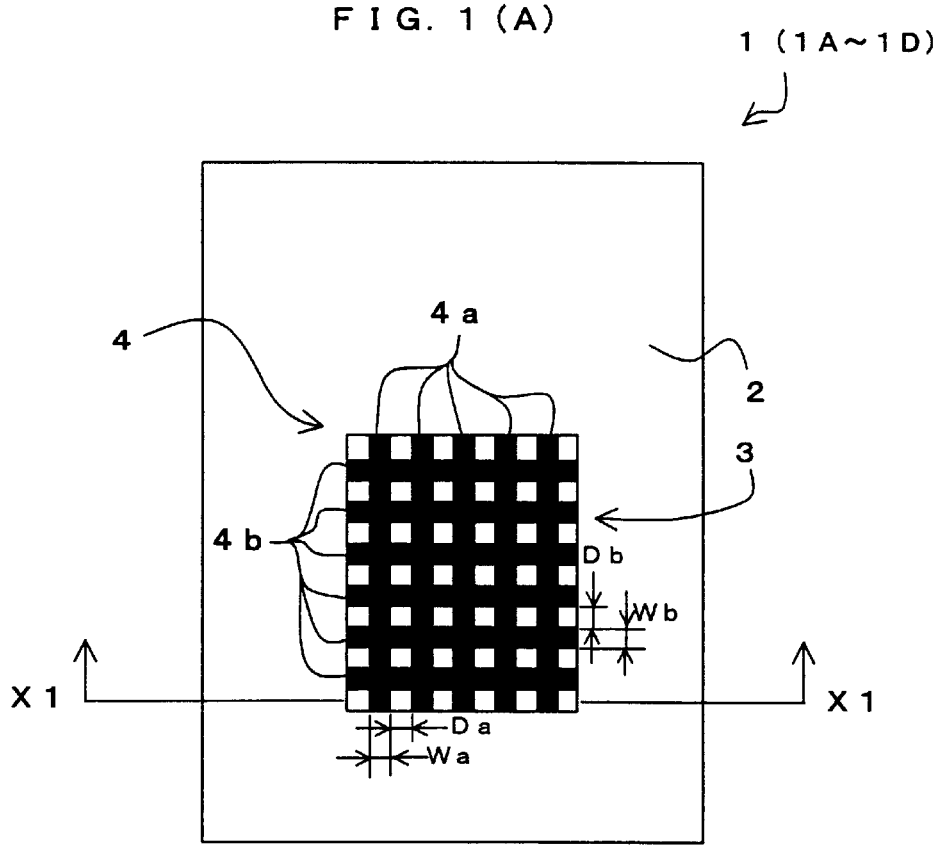
FIGS. 1(A) and 1(B) are illustrations of a configuration of a luminescent device (structured lighting material) according to an embodiment of the present invention.
Figure 1:
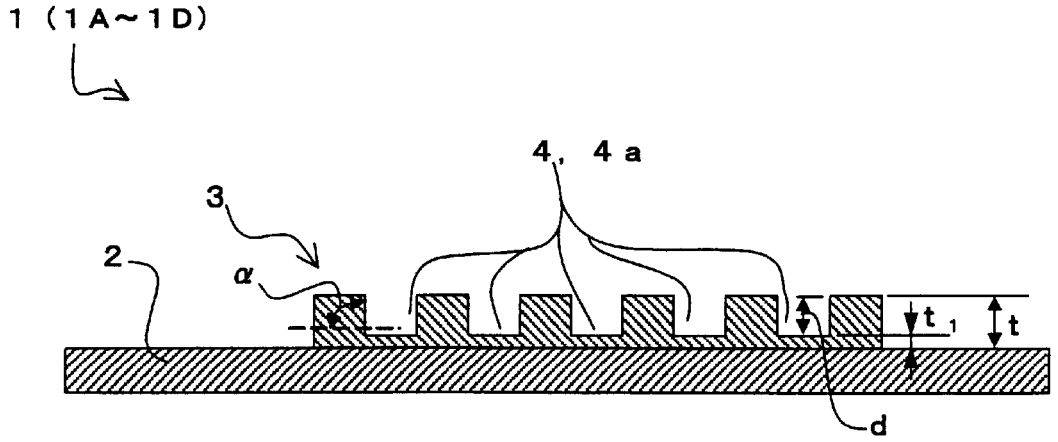
Figure 2:
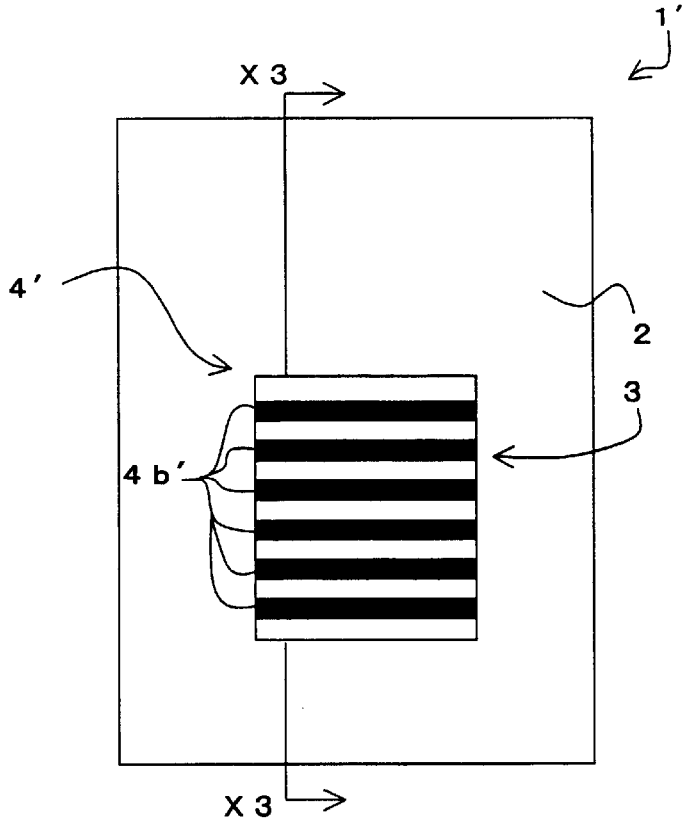
FIGS. 2(A) and 2(B) are illustrations of another configuration of a luminescent device (structured lighting material) according to an embodiment of the present invention.
Figure 2:
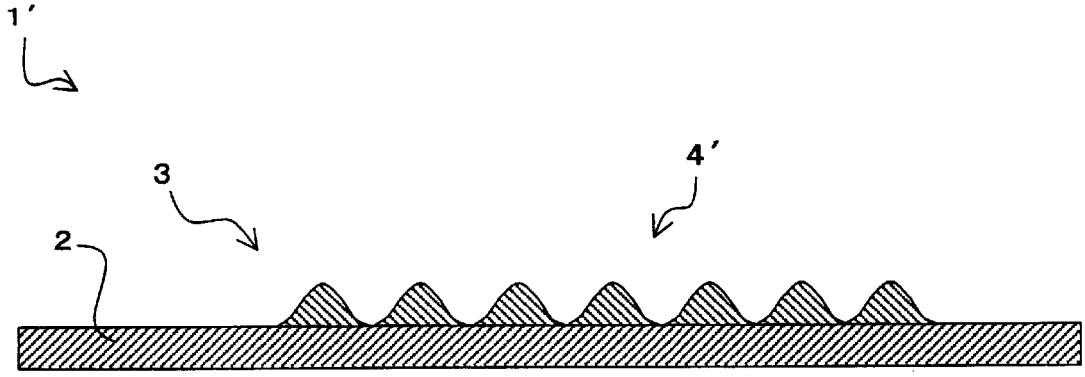

FIGS. 1(A), 1(B), 2(A) and 2(B) are illustrations of a luminescent device according to an embodiment of the present invention. FIGS. 1(A) and 1(B) are illustrations of a configuration thereof, and FIG. 1(A) is an illustrative plan view while FIG. 1(B) is an illustrative enlarged cross-sectional view taken along a line X1—X1 of FIG. 1(A), and FIGS. 2(A) and 2(B) are illustrations of another configuration thereof, and FIG. 2(A) is an illustrative plan view while FIG. 2(B) is an illustrative enlarged cross-sectional view taken along a line X3—X3 of FIG. 2(A).

As FIGS. 1(A) and 1(B) show, this luminescent device (structured lighting material) 1 comprises a metal-made (for example, copper-made) substrate 2 and an insulation (non-electrical conductive) luminescent unit 3 adhered on the substrate 2, and grooves 4 are made in a lattice-like fashion in the luminescent unit 3.

A luminescent material for the formation of the luminescent unit 3 requires only a non-electrical conductive property, and materials applicable to the conventional luminescent devices are also applicable as the luminescent material, for example, television red phosphor ($Y_2O_2S$:Eu, Tb), blue phosphor ($SrHfO_3$:Tm) or the like put on the market.

Incidentally, in this case, the insulation (non-electrical conductive) property signifies that the electrical resistivity is not below $10^6$ Ω·cm. In particular, as the luminescent material, a material of the electrical resistivity R equal to or above $10^8$ Ω·cm ($R \geqq 10^8$ Ω·cm) is preferable.

In addition, although the luminescent material for the formation of the luminescent unit 3 can be organic or inorganic luminescent materials, the inorganic luminescent material is more preferable because of high stability (less degradation) during input of electric energy thereto (particularly, during the input of electron beam).

As a preferred example of the luminescent material for the formation of the luminescent unit 3, a description will be given hereinbelow of a non-electrical conductive inorganic luminescent material. As the inorganic luminescent material, conventional materials for use in a wide range of applications, such as display tubes, luminescent lamps, X-ray/radioactive ray detective devices and luminescent display tubes, are available.

A typical example of the inorganic luminescent material is an inorganic phosphor, and the inorganic phosphor is produced in the form of powder in the usual way and it is conventional practice to form the luminescent unit 3 by adhering this phosphor powder to the substrate 2. An insulating film or the like can be properly interposed between the metal-made plate (substrate) 2 and the powder layer (luminescent unit) 3.

Furthermore, a significant feature of this structured lighting material is that grooves 4 are made in the luminescent unit 3 in a lattice-like fashion as mentioned above. For easy formation of the grooves 4, for example, after the luminescent unit 3 is formed in a manner that the phosphor powder is adhered onto the substrate 2 according to a method which will be described later, the luminescent unit 3 is whittled with a sharp-edged tool such as a tip portion of a pincette. In this case, as FIG. 1(A) shows, the grooves 4 includes vertical grooves 4*a* made in vertical directions and horizontal grooves 4*b* made in horizontal directions.

The luminescent unit 3 is made to emit light when receiving electric energy such as electron beam, electric charge or electric field from the external in a non-contact manner (without coming into direct contact with the energy source), and in this connection, the inventors have found, in process of diverse experiments on the structured lighting material, that if crests, grooves, projections or the like arranged in a lattice-like configuration, or a combination of more than one configuration of them, are made on the luminescent unit 3 so that a minute uneven surface is formed on a surface of the luminescent unit 3, a new luminescent spectrum component occurs in the vicinity of local uneven sites (high and low portions) when energy applied to the uneven surface of the luminescent unit 3 exceeds a threshold; in consequence, the luminescent intensity increases. Furthermore, the luminescence intensity from the output light of the luminescent unit 3 increases superlinearly with respect to the applied energy. Even the luminescent color varies as the energy (excitation energy) applied to the luminescent unit 3 exceeds the threshold; the luminescent color varies in accordance with the energy that goes above or below the threshold. In this case, usually, the light emitted from the luminescent unit 3 is incoherent. The term "incoherent (non-coherent)" signifies that lights emitted from two arbitrary points of the luminescent unit do no interfere with each other, and it is easily distinguished from coherent light such as laser light.

The minute uneven surface signifies fabrication including a surface having very small projections (convexities, high portions) and very small holes (concavities, low portions), or having uneven cross-section such as a wave-like (corrugated) or rectangle-arranged cross-section, with the uneven cross-section comprising projections/small holes, waves, rectangles or the like being arranged regularly or irregularly.

Preferably, this minute uneven surface satisfies the condition which will be defined later in the claim (any one of claims 6 to 12). In general, the minute uneven surface comprises a large number of high portions such as poly-sided pyramid (including trigonal pyramid, quadrangular pyramid) or cones, frustums (including frustums of trigonal pyramid, frustums of quadrangular pyramid or frustums of cone), or pseudo-cones wherein head portions have mountain-like or hemispherical shapes and a large number of low portions as opposed to these high portions. It is particularly preferable to employ regular/irregular pattern comprising a large number of cones or pseudo-cones wherein head portions have mountain-like or hemispherical shapes. These high and low portions can also be arranged regularly or irregularly. Moreover, it is also possible that the low portions are arranged to overlap continuously with each other for making a groove-like configuration, or that the high portions are made in a continuously overlapping fashion to provide a mountain-range-like configuration.

The layer thickness of the luminescent unit 3 is not particularly specified before its surface is made uneven. Any thickness is acceptable provided so the formation of the minute uneven surface exists. However, preferably, the layer thickness ranges from 100 $\mu$m to 3000 $\mu$m. If the unevenness on the uneven surface is too minute (if the difference in height between the high and low portions is too small), the prominent increase of luminescence is hardly observed. For this reason, the local variation up to 20 $\mu$m is disregarded. In other words, it is preferable that the difference in height between the high and low portions is set to be above 20 $\mu$m.

Although the mechanism of change of the luminescent character under the non-contact application of the energy to the structured lighting material with the minute uneven surface does not yet reach definite understanding, it is inferred that the following mechanism which may cause the luminescent intensity to increase superlinearly when excitation energy exceeds a threshold.

When energy such as electron beam irradiation is provided to the luminescent unit 3, the host of a luminescent material forming the luminescent unit 3 is so excited that many electron-hole pairs are generated in the luminescent material. At this time, the electron-hole pairs move with energy toward the luminescence centers in the luminescent material, thereby developing the luminescence by their recombination. This is a luminescence mechanism taking place in an ordinary structured lighting material (luminescent device).

In the present invention, since the phosphor powder layer (luminescent unit) 3 shows a non-electrical conductive property, the powder layer 3 falls into an electrified condition. In this case, if a minute uneven surface with non-uniform thickness is made on the luminescent unit 3 in such a manner as to make the grooves 4 in the luminescent unit 3 as mentioned above, then the electric field of the luminescent unit 3 becomes non-uniform, which leads to a locally high electric field in the vicinity of the uneven surface. The uneven surface can induce local electric field concentration. In this case, the point is that the minute uneven surface of the luminescent unit 3 is any fabrication to enable non-uniformity of electric field.

Thus, in a case in which the luminescent unit 3 is extremely easily electrified, more electrons are stored in the vicinity of the surface of the luminescent unit 3 as the energy applied from the external becomes larger. Therefore, a local strong electric field accordingly takes place in the vicinity of the surface of the luminescent unit 3.

When the strength of this electric field exceeds a threshold (that is, when the applied energy exceeds a threshold), electrons and/or holes caught at a deep level in the host of the luminescent unit are discharged into conduction bands and/or valence bands in the Poole-Frenkel process or the Fowler-Nordheim process or the both and accelerated by the strong electric field to excite the luminescence centers, and/or applying an extremely strong electric field reduces the width of the barrier confining the electrons and/or holes to cause carrier injection in tunnel processes so that the carriers are accelerated by the strong electric field to excite the luminescence centers.

Furthermore, the luminescence centers can be not only impurities representing simple metals/transition metals doped on purpose but also potential point defects, line defects, plane defects or surface defects occurring in the manufacturing process for the luminescent unit 3. Accordingly, in addition to the occurrence of carriers by the energy such as electron beam excitation, strong electric field takes place by minute uneven configuration in which the thickness of the luminescent unit 3 is made non-uniform in a manner that the grooves 4 are made in the non-electrical conductive luminescent unit 3 as described above. This strong electric field thus create many carriers. Furthermore, it can be considered that the carriers increase the intensity of the luminescence from the luminescence centers doped intentionally and further increases the intensity of the luminescence from the luminescence center which is made by potential defects/impurities introduced in the manufacturing processes. From this consideration, it can be considered that the luminescent intensity of the luminescent unit 3 increases superlinearly when the energy given through the use of electron beam irradiation or the like exceeds a threshold.

A description will be given hereinbelow of a threshold of input energy for a sudden change of the luminescence character of the luminescent unit 3. This threshold depends upon various kinds of conditions of the luminescent unit 3. The threshold can be set at a desired value through the adjustment of these conditions; luminescent materials, synthesis conditions [kind and quantity of flux, firing temperature, firing time, time taken for a cooling temperature, after-treatment (grinding method, washing method, drying method, and others)], manners for applying phosphor powder to the substrate 2 (the way for the adhesion on the substrate 2) and additional treatment thereon, degree of unevenness in the minute uneven surface (that is, non-uniformity in thickness, and specifically, the number of grooves 4, shape, depth, surface unevenness (roughness) of the luminescent unit 3, or the like).

In the example shown in FIGS. 1(A) and 1(B), each of the vertical grooves 4*a* and each of the horizontal grooves 4*b* are formed to have width Wa and Wb, respectively, and the vertical grooves 4*a* and the horizontal grooves 4*b* are spaced by Da and Db from each other, respectively, and located at equal intervals. In this case, these width Wa, Wb and spaces Da, Db are set at approximately 1 mm. In addition, for a depth d of the grooves 4, in a case in which the luminescent unit 3 has a thickness t, it is preferable that the maximum thickness (in this case, the thickness of a portion at which no groove 4 exists) t of the luminescent unit 3 is set at three or more times [$t \geqq 3(t-d)$] the minimum thickness (in this case, the thickness at a portion at which the groove 4 exists) $t_1(=t-d)$. More preferably, the maximum thickness t is ten or more times [$t \geqq 10(t-d)$] the minimum thickness $t_1$.

In particular, at high and low portions adjacent to each other, it is preferable that the maximum thickness t is set at three or more times the minimum thickness $t_1$, more preferably, ten or more times.

Still additionally, preferably, the depth (the height of the high portion or convexity) d is set at 20 μm or more (d≧20 μm) in a view of securing the luminescence performance of the present invention.

From the viewpoint of making effective the unevenness of the surface of the luminescent unit 3, in the example shown in FIGS. 1(A) and 1(B), it is preferable that the minimum thickness $t_1$ is set to be 500 μm or below ($t_1$≦500 μm), more preferably, 70 μm or below ($t_1$≦70 μm)), and most preferably, 50 μm or below ($t_1$≦50 μm). Moreover, the minimum thickness $t_1$ is possible to be 0.01 μm or more ($t_1$≧0.01 μm), 0.5 μm or more($t_1$≧0.5 μm)), and also, 1 μm or more ($t_1$≧1 μm).

In addition, in the example shown in FIGS. 1(A) and 1(B), preferably, the maximum thickness t is 100 μm or more (t≧100 μm), and more preferably, 200 μm or more (t≧200 μm). Moreover, the maximum thickness t is possible to be 3 mm or below (t≦3 mm), or 500 μm or below (t≦500 μm).

From the same viewpoint of making effective an unevenness of the surface of the luminescent unit 3, in the example shown in FIGS. 1(A) and 1(B), it is preferable that the angle α of inclination (slope) of an uneven surface is in a range from 30 degrees to 150 degrees, more preferably, in a range from 50 degrees to 130 degrees, and further preferably, in a range from 50 degrees to 88 degrees. This inclination (slope) angle α of the uneven surface signifies an angle of a side surface (a surface other than a vertex surface and a base) of the uneven site with respect to a plane parallel to the substrate.

The layer thickness of the luminescent unit 3 and the aforesaid parameters of the uneven surface can easily be measured with a non-contact type three-dimensional analysis apparatus (for example, a laser microscope). For example, the employment of an image measurement CNC three-dimensional analysis apparatus manufactured by MITUTOYO Co., Ltd. or an ultra-depth shape measuring microscope manufactured by KEYENCE Co., Ltd. enables the measurements of the maximum thickness/minimum thickness of one uneven surface and the inclination angles of uneven surfaces.

As mentioned above, no limitation is imposed in shape on the grooves 4 as long as it produces non-uniform thickness of the luminescent unit 3 for a minute uneven surface in the luminescent unit 3.

For example, the parameters Wa, Wb, Da and Db are not limited to the above-mentioned values. Moreover, the luminescent unit 3 having the uneven surface can also be located on an end portion of the substrate 2. Still moreover, the vertical grooves 4*a* are not always required to be formed at equal intervals, and this also applies to the horizontal grooves 4*b*. Still moreover, although the grooves 4 are formed such that the vertical grooves 4*a* and the horizontal grooves 4*b* are arranged to be substantially orthogonal to each other, it is also acceptable that grooves formed along the first direction at equal or unequal intervals and grooves formed along the second direction at equal or unequal intervals are arranged to obliquely cross each other at angles other than the right angle.

In addition, it is also possible to use only a single or plural vertical grooves 4*a,* or to use only a single or plural horizontal grooves 4*b*. Alternatively, it is also possible that grooves are formed in irregular directions at unequal intervals.

Still additionally, a luminescent device (structured lighting material) 1' shown in FIGS. 2(A) and 2(B) is also employable. The luminescent device comprises a substrate 2, a luminescent unit 3 adhered on the substrate 2 and grooves 4' formed in the luminescent unit 3. In FIG.2(A), the grooves 4' comprises horizontal grooves 4*b*' arranged at equal intervals in vertical directions, with each of the horizontal grooves 4*b*' formed to extend along the horizontal directions. The luminescent unit 3 has a wave-like cross-sectional configuration as shown in FIG. 2(B), and the deepest portion thereof nearly reaches the substrate 2.

Besides such grooves, it is also acceptable that holes are made in the luminescent unit 3 at an equal or unequal intervals by means of a sharp-edged tool. Many kinds of defects are made in the luminescent unit 3 at random; grooves, holes and any other type of defects are made in the luminescent unit 3 in a mixed state.

Furthermore, a description will be given hereinbelow of a method to adhere phosphor powder to the substrate 2 for the formation of the luminescent unit 3 on the substrate 2. Among the adhesion methods, there are settling coating, dusting, dip coating, deposition, ablation, sputtering, CVD, a painting method using a tool such as a brush, and others.

A description will be given hereinbelow of an adhesion method based on settling coating using water-glass aqueous solution as binder (sticking agent) and an adhesion method based on dusting without binder.

First of all, the description starts at one example of settling coating using water-glass aqueous solution as binder. Ion exchange water of 175 ml (milliliter) and high-concentration water-glass aqueous solution (high-concentration potassium silicate aqueous solution) of 25 ml are mixed with each other to produce water-glass aqueous solution, and this water-glass aqueous solution of 20 ml is put in a beaker with a capacity of 100 ml, and phosphor powder of 0.2945 g is additionally put in this beaker to produce a mixture of the water-glass aqueous solution and the phosphor powder. An ultrasonic dispersion is conducted on this mixture solution of the water-glass aqueous solution and the phosphor powder for 10 minutes.

Subsequently, barium acetate aqueous solution (0.05 wt %) of 25 ml is put in the 100-ml beaker, and in a state where it is placed on an aluminum plate, two substrates (bases) 2 (for example, made of copper) are dipped in the barium acetate aqueous solution within the beaker. Moreover, the water-glass aqueous solution containing the phosphor powder (mixture solution of the water-glass aqueous solution and the phosphor powder) after the ultrasonic dispersion is put in the beaker accommodating the substrates 2 and the barium acetate aqueous solution while stirred. Still moreover, after the completion of the precipitation of the phosphor powder in the mixture solution of the barium acetate aqueous solution and the water-glass aqueous solution, the substrates 2, together with the aluminum plate, are removed from this mixture solution, and the substrates 2 are dried in air for about one day. Thus, the phosphor powder is adhered onto the substrates 2 to form the luminescent units 3 on the substrates 2.

Secondly, a description will be given hereinbelow of a method of adhering fine particles (phosphor powder) on the substrate 2 by means of dusting without using binder. In this method, for example, after one sticking surface of an adhesive double coated tape is attached to a surface of the substrate 2, a phosphor powder is dusted on the other surface of the adhesive double coated tape so that the phosphor powder is adhered through the adhesive double coated tape onto the substrate 2 (the luminescent unit 3 is formed on the substrate 2).

The water-glass aqueous solution shows electrical conductive property. Therefore if the water-glass aqueous solution is used as binder, there is a possibility of degrading the non-electrical conductive property (deteriorating the electrification characteristic) of the luminescent unit 3, since the water-glass component is contained in the luminescent unit 3. So it is preferable that the dusting which requires no binder such as water-glass aqueous solution is used as a method to adhere the phosphor powder on the substrate 2.

In this connection, the dusting does not always require the use of such an adhesive tape. It allows other adhesive (for example, barium acetate aqueous solution) to be applied on to the substrate 2 before powder(phosphor powder)is dusted on the substrate 2 and dried.

A more specific example of the dusting will be described below. A potassium silicate aqueous solution (concentration: 28.03 wt %, specific gravity: 1.244) is collected approximately two droplets (about 0.5 ml) by a dropping pipet and dropped on a copper-made substrate (28 mm×20 mm) plated with nickel. In addition, this copper-made substrate is dried in air for only two or three hours or is dried sufficiently through the use of a drier or the like. Following this, a barium acetate solution (concentration: 0.05 wt %) is taken approximately one droplet (approximately 0.2 ml) by a dropping pipet and is dropped on a portion of the substrate holding the potassium silicate aqueous solution applied and dried.

This treatment produces sol-like silica on the substrate. Phosphor powder is dusted thereonto (dusting). In this case, it is preferable that the dusting is conducted so that the weight density of the applied film becomes approximately 50 mg/cm$^2$ to 100 mg/cm$^2$. However, the weight density of the applied film is not limited to this. After the coating of the phosphor powder, it is vacuum-dried, thereby realizing a dusting-applied film.

Although the method to adhere phosphor powder onto the substrate 2 is not limited to the above-mentioned methods, it is preferable to employ a method of maintaining the non-electrical conductive property of the phosphor powder without providing the electrical conductive property for easy electrification of the luminescent unit 3, such as the above-mentioned dusting (including methods by which the luminescent unit 3 can be easily electrified after the adhesion of the phosphor powder on the substrate 2).

A luminescent device forming one embodiment of the structured lighting material according to the present invention is fabricated as described above. The inventors have found the following phenomena by forming a minute uneven surface structure non-uniform thickness, for example, the grooves 4 are formed in the luminescent unit 3 with a non-electrical conductive property.

Thus, the intensity of luminescence outputted from the luminescent unit 3 increases superlinearly with respect to the input of the energy when the applied energy exceeds a threshold, and this luminescent intensity is extremely higher as compared with a conventional luminescent device. Furthermore, depending on conditions, the luminescent color begins to vary around this threshold.

Since the luminescent state of the luminescent unit 3 strongly depends on the magnitude of the inputted energy near the threshold, it is possible to visually detect the variance of the energy inputted to the luminescent unit 3 around the threshold by monitoring the luminescent state (luminescent intensity or luminescent color) of the luminescent unit 3 with this luminescent device. This enables the luminescent device to be used for detectors or alarms.

In addition, since the luminescent state of the luminescent unit 3 shows rapid variation around the threshold, the variation of the luminescent state near the threshold can be used as on/off signal, and is applicable to memories or various types of control device.

Still additionally, since higher luminescent intensity is obtainable as compared with that of the conventional element, an illuminator such as a high-efficient illuminating apparatus is feasible. As the illuminator, the structured lighting material according to the present invention is applicable to display tubes (such as image tubes and cathode-ray lamps which will be described later as application examples) as well as indoor illumination, projectors, back lights, and so forth.

In any case, this luminescent device can provide useful effects in a wide range of applications owing to its rapid variation of the luminescent state and its high-efficiency. Thus it is a significant invention. Moreover, since the present invention requires only a minute uneven surface of the luminescent unit formed by making simple grooves on the convention luminescent device, this permits the utilization of the conventional manufacturing processes for the luminescent devices. Various kinds of knowledge and experience on the conventional luminescent device can be applied to the product of the current invention.

The structured lighting material (luminescent device) according to the present invention is not limited to the above-described embodiments, and covers all changes and modifications of the embodiments of the invention herein which do not deviate from the spirit and scope of the invention.

For example, although the grooves 4 are made over the entire area of the luminescent unit 3 in the above-described embodiments, it is also appropriate that the grooves 4 are made in a portion of the luminescent unit 3. Also in this case, in the groove made area of the luminescent unit 3, the luminescent state changes suddenly around a threshold of the input energy.

Incidentally, in the above-described embodiments, a luminescent unit with a structured lighting material according to the present invention is composed of phosphor, it is also possible to use other organic and/or inorganic material.

EXAMPLES

Referring to the drawings, a further description will be given in detail hereinbelow of examples of the structured lighting materials according to the present invention. FIGS. 3 to 8 are illustrations of luminescent devices according to the examples and conventional luminescent devices used as comparative examples. In FIGS. 4, 5, 7 and 8, dots represent the actually measured values, and a current dependency curve of the luminescent intensity is drawn by smoothly connecting these dots. Moreover, FIGS. 1(A) and 1(B) used for the description of the above embodiments and FIGS. 11(A) and 11(B) for the description of the conventional technique will also be used for the following description. Incidentally, the structured lighting material according to the present invention is not limited to the examples as disclosed in the below.

(A) First Example

A luminescent device 1A according to this example of the present invention was, as well as the luminescent device 1 according to the above-described embodiment, composed of a substrate 2, a luminescent unit 3 formed on the substrate 2 and lattice-like grooves 4 formed in the luminescent unit 3 as shown in FIGS. 1(A) and 1(B). The substrate 2 was made of a copper plate, and the luminescent unit 3 was formed on the substrate 2 in a manner that red phosphor ($Y_2O_2S$: Eu, Tb) powder for televisions was settling-coated in water-glass aqueous solution and then dried sufficiently.

The lattice-like grooves 4 were made in a state where vertical grooves 4*a* and horizontal grooves 4*b* were arranged at equal intervals (for example, 1 mm). The grooves 4*a* and 4*b* were made by scratching the luminescent unit 3 with a sharp-edged tool such as a tip portion of a pincette.

According to the results of measurement by a non-contact type three-dimensional analysis apparatus, various kinds of parameters of minute uneven surface were such that the maximum thickness was in a range from 200 $\mu$m to 500 $\mu$m while the minimum thickness was in a range from 20 $\mu$m to 50 $\mu$m, and the inclination angle of the uneven surface ranged from 50 degrees to 88 degrees.

Figure 11:
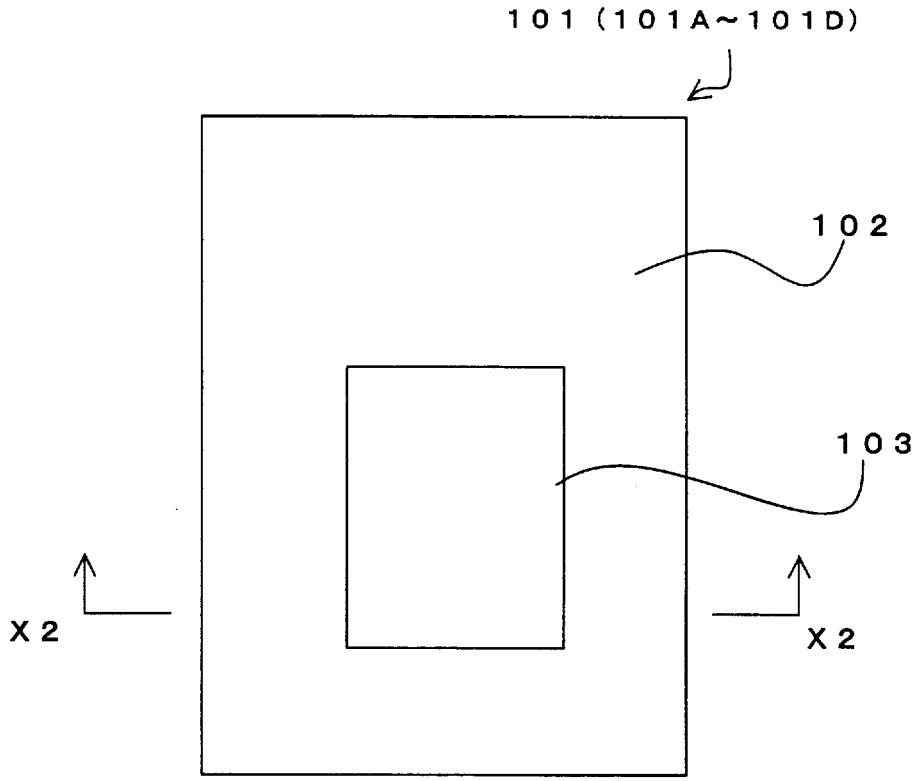
FIGS. 11(A) and 11(B) are illustrations of a configuration of a conventional luminescent device (structured lighting material)
Figure 11:
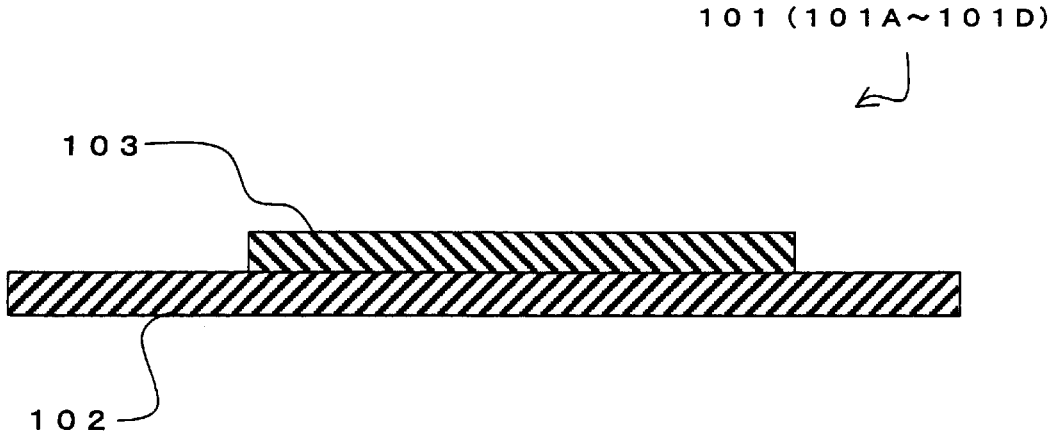

A luminescent device 101A with a conventional fabrication was produced as a comparative example to the luminescent device 1A. This luminescent device 101A with the conventional fabrication was made to have the same configuration as that of the luminescent device 1A except that the grooves 4 were not made therein, and the manufacturing method thereof was the same as the method for the luminescent device 1A, but with no procedure for the formation of the grooves 4. That is, this luminescent device 101A with the conventional fabrication was made up of a copper-made substrate 102 and a luminescent unit 103 form on the substrate 102 as shown in FIGS. 11(A) and 11(B), and the luminescent unit 103 was formed in a manner that television red phosphor ($Y_2O_2S$: Eu, Tb) powder was settling-coated on the substrate 102 in water-glass aqueous solution.

Figure 3:
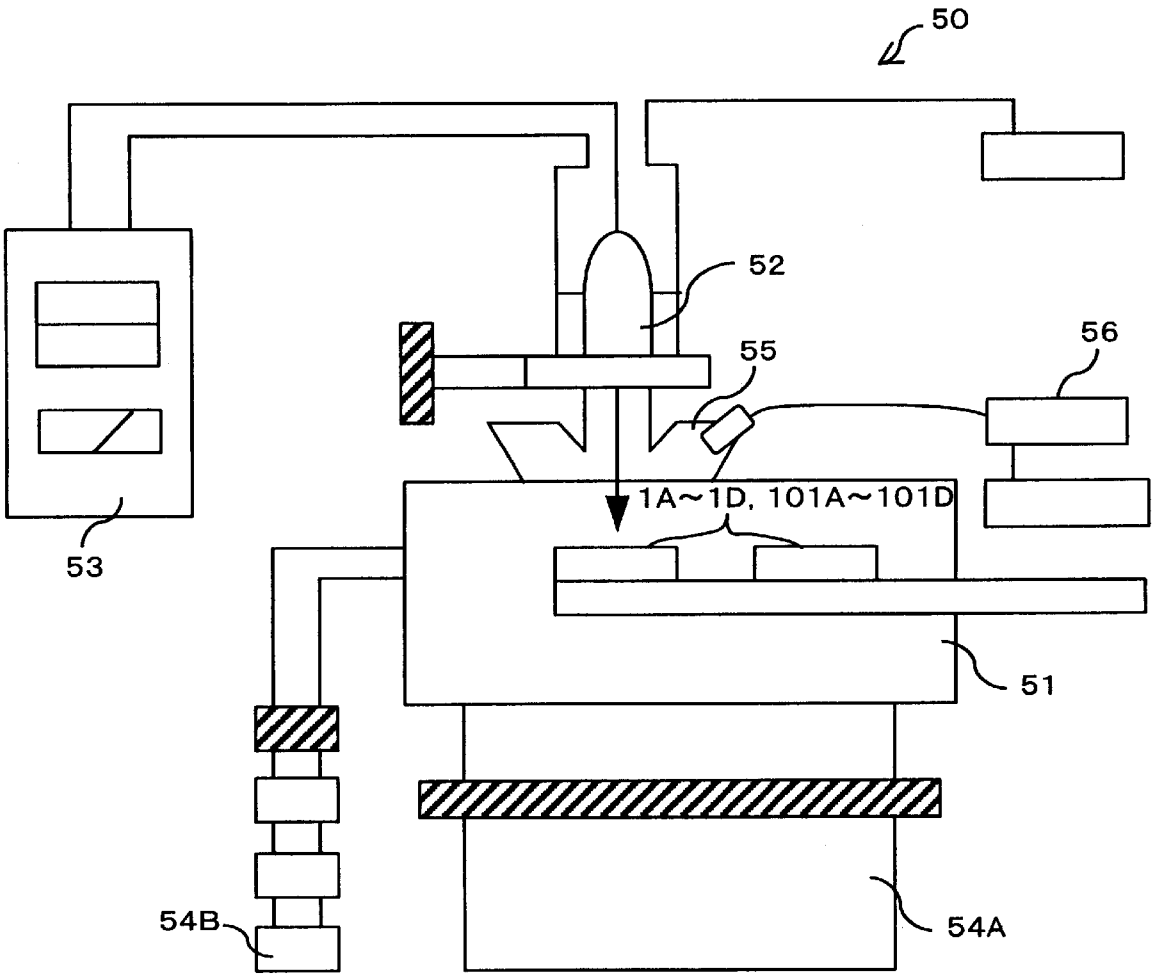
FIG. 3 is a side elevation view illustratively showing a configuration of an experimental equipment according to the first example of the present invention.

The current dependency of luminescent intensity was measured on the luminescent device 1A according to the example of this invention and the conventional luminescent device 101A using an experimental equipment 50 shown in FIG. 3.

A description will be given hereinbelow of this experimental equipment 50. As FIG. 3 shows, the experimental equipment 50 is made up of a vacuum device 51 accommodating the samples (the luminescent devices) 1A and 101A being measured and placed internally in a substantial vacuum condition, an electron gun 52 for applying an electron beam to the samples measured in the vacuum device 51, a high-voltage power supply 53 for supplying high-voltage power to the electron gun 52, a sputter ion pump 54A and turbo-molecular pump 54B for making the interior of the vacuum device 51 vacuous (up to $1\times10^{-5}$ Pa), and an observation window or port 55 for observation of the interior of the vacuum device 51. The observation window 55 is also used as an entry through which an electron beam evaluation device 56 or a luminescent spectrometer (not shown) is inserted into the interior of the vacuum device 51.

In this equipment 50, first, after the luminescent device 1A and 101A are set in the interior of the vacuum device 51, the sputter ion pump 54A and the turbo-molecular pump 54B are properly manipulated so that the interior of the vacuum device 51 forms a vacuum below a sufficient degree of vacuum (for example, $1\times10^{-5}$ Pa). In addition, the high-voltage power supply 53 is actuated to apply electron beam from the electron gun 52 to the luminescent device 1A and 101A in the interior of the vacuum device 51, and the current dependency of luminescent intensity of each of the luminescent device 1A and 101A is measured with the electron beam evaluation equipment 56.

Figure 4:
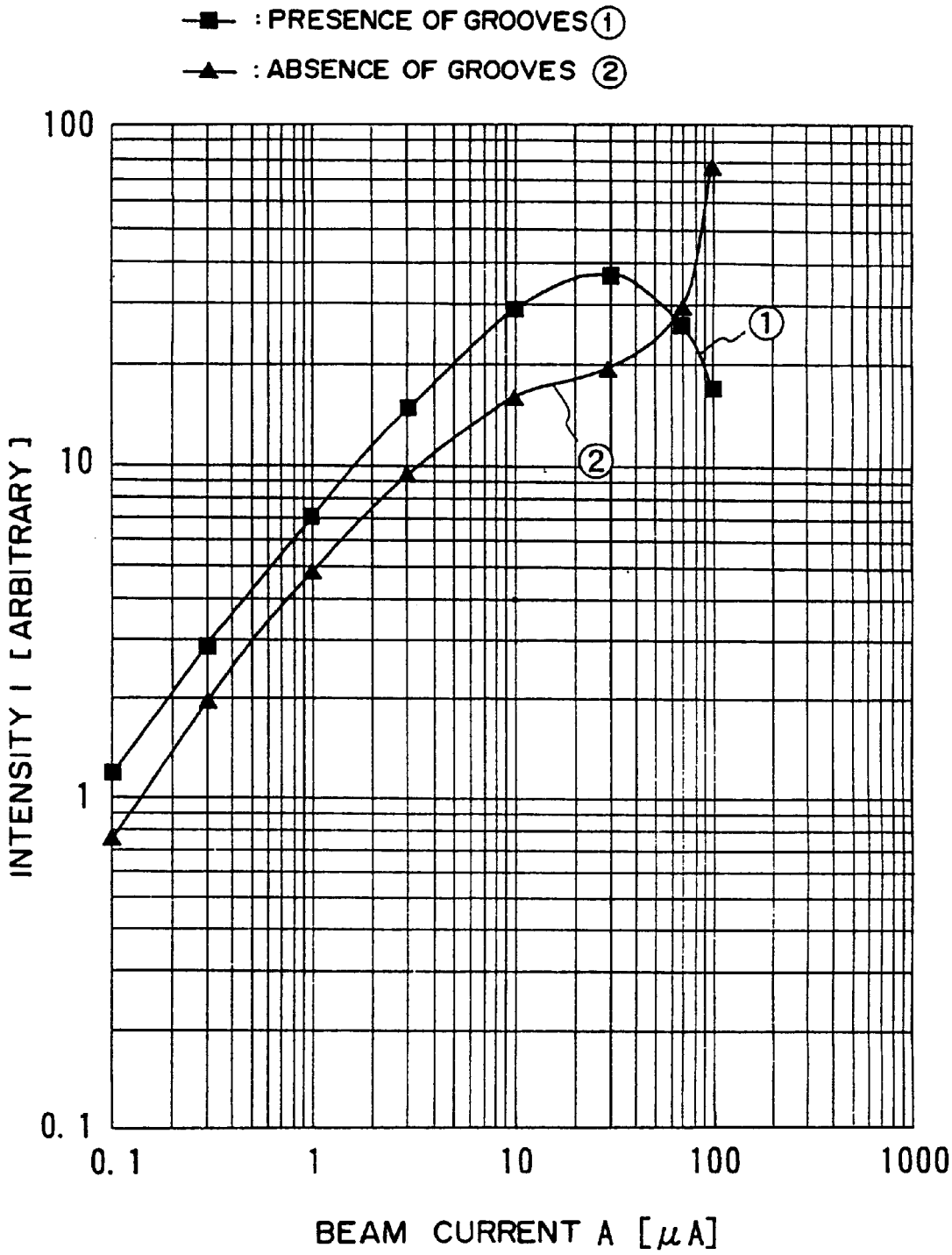
FIG. 4 is an illustration of measurement results of an experiment on the current dependency of luminescent intensity in a luminescent device (structured lighting material) according to the first example of the present invention and a conventional luminescent device.

FIG. 4 is a log-log graph where the vertical axis represents luminescent intensity I of a luminescent device and the horizontal axis denotes beam current (current value) A fed to the electron gun 52 (that is, energy applied to the luminescent device 1A or 101A). In the conventional luminescent device 101A, as denoted by circled numeral 1 in FIG. 4, the luminescent intensity I increased monotonically with increase in beam current A until the beam current A approaches approximately 30 $\mu$A, while the luminescent intensity I decreased when the beam current A exceeded 30 $\mu$A.

The luminescent intensity I of this luminescent device 1A is denoted by circled numeral 2 in FIG. 4. The luminescent intensity I of this luminescent device 1A increased monotonically with an increase in the beam current A until the beam current A goes to the vicinity of the 20 $\mu$A just as the conventional luminescent device 101A does. When the beam current A exceeded approximately 20 $\mu$A, the increase tendency thereof went upward rapidly so that the luminescent intensity increased superlinearly to reach an extremely high value. This result was contrary to the case of the conventional luminescent device 101A.

This demonstrated that, if the grooves 4 are made in the luminescent unit 3 so that the luminescent unit 3 has a minute uneven surface non-uniform in thickness, the luminescent intensity I increases superlinearly when the beam current A exceeds a threshold $A_0$ (in this case, approximately 20 $\mu$A), and an output can be higher than that of the conventional luminescent device 101A.

When the beam current A is below the threshold $A_0$, the luminescent intensity I of this luminescent device 1A is lower than that of the conventional luminescent device 101A. This is because the area of the luminescent unit 3 of the luminescent device 1A, including the grooves 4, is made to be equal to the area of the luminescent unit 103 of the conventional luminescent device 101A; the luminescent device 1A has a smaller luminescence area of the luminescent unit 3 than that of the conventional luminescent device 101A by area corresponding to the grooves 4.

(B) Second Example

In this example, a luminescent device 1B (having grooves 4) according to the second example of the present invention and a luminescent device 101B with a conventional fabrication (having no grooves) were prepared. Here, blue phosphor ($SrHfO_3$: Tm) invented previously was used for the luminescent device 1B and 101B.

The luminescent device 1B is made up of a copper-made substrate 2, a luminescent unit 3 and lattice-like grooves 4 as well as the above-mentioned luminescent device 1A according to the first example as shown in FIGS. 1(A) and 1(B). The luminescent unit 3 was made on the substrate 2 with the blue phosphor ($SrHfO_3$:Tm) powder being settling-coated in water-glass aqueous solution.

The luminescent device 101B is composed of a copper-made substrate 102 and a luminescent unit 103 formed by settling-coating blue phosphor ($SrHfO_3$:Tm) powder onto the substrate 102 in water-glass aqueous solution.

The blue phosphor ($SrHfO_3$:Tm) powder synthesis is feasible according to the methods disclosed in Japanese Patent Laid-Open Nos. HEI 8-283713, 10-121041 and 10-121043.

Usually, for the blue phosphor ($SrHfO_3$:Tm) powder synthesis, Sr (strontium) oxide, hydroxide, carbonate or nitrate, Hf (hafnium) oxide and others were weighed for a quantity and intermixed sufficiently, and in a heat resistance vessel such as a crucible, this mixture was fired once or more times at a temperature of 800 to 1600° C. for one to twelve hours in air or in oxidation atmosphere.

Specifically, in this case, the blue phosphor powder synthesis was conducted as follows.

As raw materials, there were prepared $SrCO_3$ (4N), $HfO_2$ (3N) and $Tm_2O_3$ (powder 3N) or $Tm(NO_3)_3$ (solution, 3N). In addition, alkali metal chloride (carbonate, nitrate or the like) is used as flux, and in this case, $Na_2CO_3$ (4N) was prepared by 10 mol % of a phosphor to be produced. The numerals in parentheses represent purities.

Moreover, these are weighed in stoichiometric ratio and wet-blended in a mortar. And in a heat resistance vessel such as an alumina crucible, this mixture was fired at a temperature of 1600° C. for four or five hours in air or in oxidation atmosphere. Then, grinding, washing, drying and sieving were conducted on this fired material for the powder synthesis of the blue phosphor ($SrHfO_3$:Tm) after removal of coarse particles.

Figure 5:
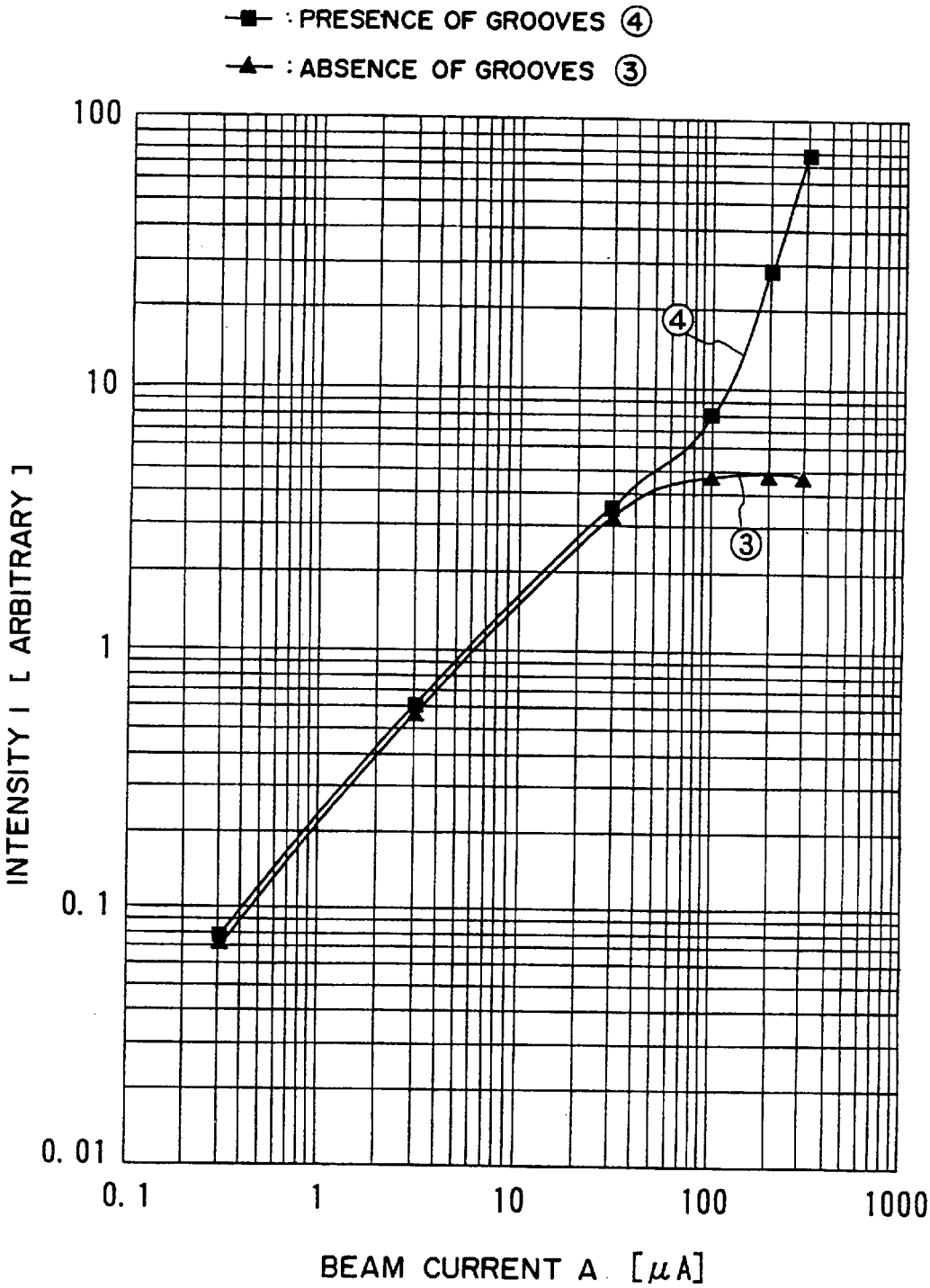
FIG. 5 is an illustration of measurement results of an experiment on the current dependency of luminescent intensity in a luminescent device (structured lighting material) according to the second example of the present invention and a conventional luminescent device.
Figure 6:
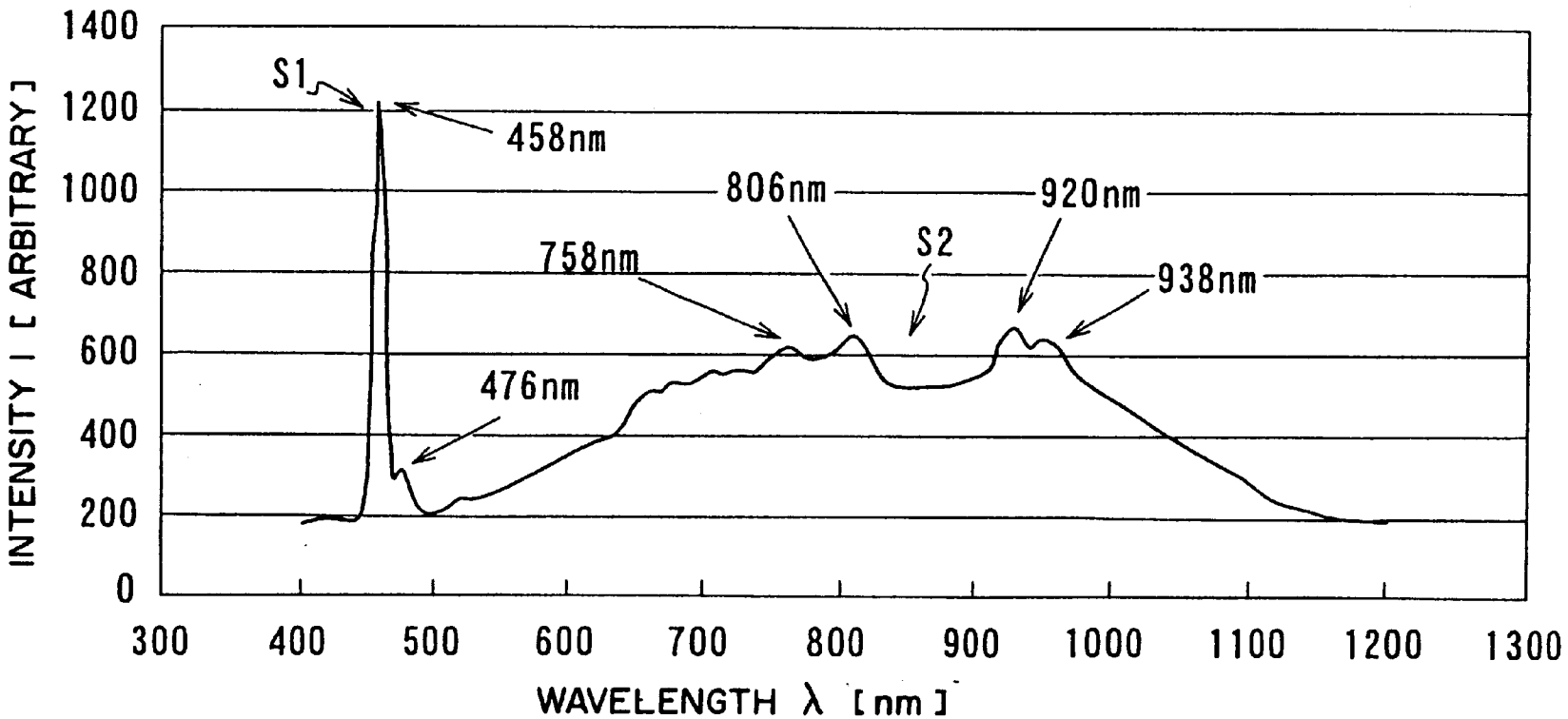
FIG. 6 is an illustration of results of measurement of a luminescent spectrum of a luminescent device (structured lighting material) according to the second example of the present invention.

The luminescent device 1B (the luminescent device 101B) was set in the equipment 50 shown in FIG. 3. The current dependency of luminescent intensity was measured on the luminescent device 1B and 101B with the electron beam evaluation equipment 56. The luminescent spectrum was measured by the luminescent spectrometer. FIG. 5 shows the results of measurement of the current dependency of luminescent intensity. FIG. 6 shows the results of measurement of luminescent spectrum. For the measurement of luminescent spectrum, the luminescent spectrometer (not shown) is set in place of the electron beam evaluation equipment 56.

First, a description will be given hereinbelow of the results of measurement of the current dependency of luminescent intensity. In a log-log graph of FIG. 5, the vertical axis represents luminescent intensity I of a luminescent device while the horizontal axis denotes a beam current A supplied to the electron gun 52. In the luminescent device 101B having no groove, as denoted by circled numeral 3 in FIG. 5, the luminescent intensity I increased monotonically with an increase in the beam current A until the beam current A approaches approximately 30 $\mu$A. When the beam current A became above approximately 30 $\mu$A, the increase tendency thereof went downward, and when the beam current A exceeds approximately 100 $\mu$A, the luminescent intensity I fell into a saturated condition.

On the other hand, in this luminescent device 1B having the grooves 4, as denoted by circled numeral 4 in FIG. 5, the luminescent intensity I increased monotonically until the beam current A increased up to approximately 100 $\mu$A. When the beam current A exceeded approximately 100 $\mu$A, the increase tendency thereof went upward rapidly and the luminescent intensity I increased superlinearly. In other words, the luminescent intensity I increased superlinearly when the beam current A exceeded this threshold $A_0$ (in this case, approximately 100 $\mu$A) contrary to that of the conventional luminescent device 101A.

Secondly, a description will be given hereinbelow of the results of measurement of luminescent spectrum. FIG. 6 shows a luminescent spectrum of the luminescent device 1B in a case when a beam current A larger than the threshold $A_0$ is supplied to the electron gun 52; the horizontal axis represents a wavelength $\lambda$ [nm] of the luminescence and the vertical axis denotes a luminescent intensity I.

As FIG. 6 shows, the luminescent intensity I shows a peak (luminescent peak) S1 in the vicinity of 450 nm. This luminescent peak S1 corresponds to a blue luminescent band stemming from f-f transitions of Tm forming the luminescence center of a blue phosphor ($SrHfO_3$:Tm) constituting the luminescent unit 3. Thus luminescent peak S1 appears in this luminescent device 1B even when the beam current A is below the threshold $A_0$. Also in the luminescent device with the conventional fabrication, this peak S1 was observed.

However, in this luminescent device 1B, when the beam current A exceeded the threshold $A_0$, a new luminescent band S2 ranged from 500 nm to 1200 nm in wavelength $\lambda$ as well as the blue luminescent band S1 were observed (FIG. 6), the resultant luminescent color thus turned to white.

Accordingly, from this measurement, it was demonstrated that, if the grooves 4 are formed in the luminescent unit 4 so that the luminescent unit 3 has a minute uneven configuration in thickness, the luminescent intensity I increases superlinearly and the luminescent color varies (in this case, varies from blue to white) when the beam current A exceeds the threshold $A_0$.

(C) Third Example

Figure 7:
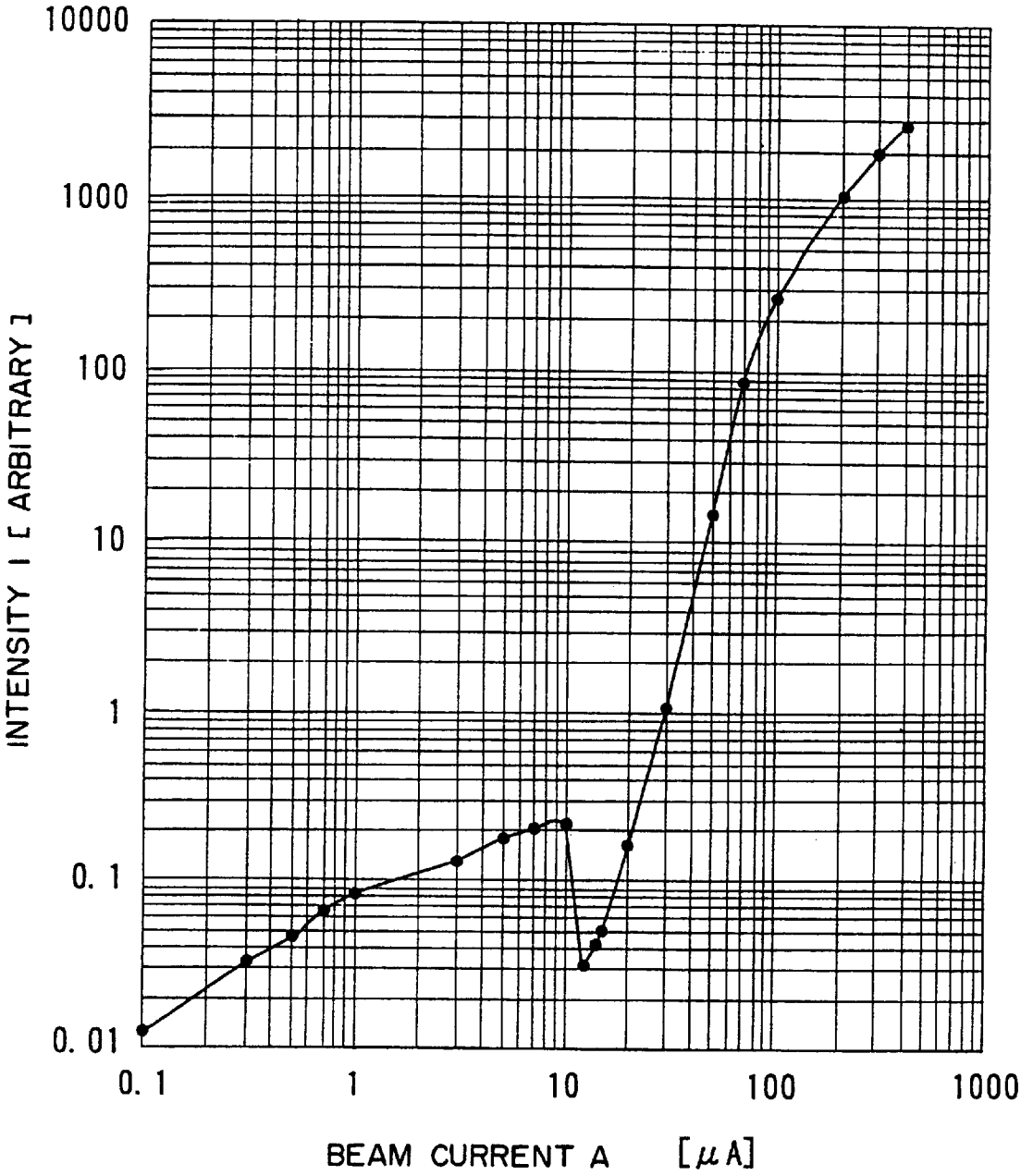
FIG. 7 is an illustration of measurement results of an experiment on the current dependency of luminescent intensity in a luminescent device (structured lighting material) according to the third example of the present invention.

In a third example of the present invention, a luminescent device 1C was made up of a copper-made substrate 2, a luminescent unit 3 formed on the substrate 2 by the dusting of phosphor powder and lattice-like grooves 4 made in the luminescent unit 3 as shown in FIGS. 1(A) and 1(B); blue phosphor ($SrHfO_3$: Tm) powder that contains KCl of 10 mol % acting as flux was used as the phosphor powder. FIG. 7 shows the current dependency of the luminescent intensity of the luminescent device 1C measured with the experimental equipment 50 shown in FIG. 3.

In a log-log graph of FIG. 7, the vertical axis represents luminescent intensity I of a luminescent device and the horizontal axis denotes beam current A to be supplied to the electron gun 52.

In the luminescent device 1C according to this example, as FIG. 7 shows, the intensity I monotonically increased until the beam current increased up to threshold (about 10 $\mu$A). The luminescent intensity I once dropped when the beam current A exceeds the threshold $A_0$. The luminescent intensity I increased superlinearly at an increase tendency greater than that below the threshold $A_0$.

In the luminescent device 1C according to this example, the threshold $A_0$ is approximately 10 $\mu$A, which was a lower value than the thresholds $A_0$ of the luminescent devices 1A and 1B according to the above-described examples. The reason of the lower threshold $A_0$ can be assumed as follows.

The above-mentioned superlinear rise of the luminescent intensity was observed when the energy applied to the luminescent device exceeded a threshold. This can be enhanced by electrification property of the luminescent unit 3. In the luminescent device according to the present invention, non-electrical conductive phosphor powder is employed for making the luminescent unit 3 acquire the electrification property, while in the luminescent devices 1A and 1B according to the above-described examples, water glass with electrical-conductive property is used as binder for the formation of the luminescent unit 3 on the substrate 2; therefore, the non-electrical conductive property of the luminescent unit 3 containing the water glass is impaired to somewhat diminish the electrification property thereof. On the other hand, in the case of this third example, since the luminescent unit 3 is produced by the dusting instead of the use of the water glass, it can be understood that the non-electrical conductive property is improved. Thus it was observed that the superlinear rise of the luminescent intensity at lower beam current A than those of the luminescent devices 1A and 1B according to the above-described examples.

(D) Comparative Examples

Besides the above-described first and second examples, an experiment was performed with a phosphor ZnO. ZnO has electrical conductive property (estimated electrical resistivity is 10 to 300 Ω·cm) in the form of phosphor powder and put on the market.

As shown in FIGS. 1(A) and 1(B), the phosphor powder ZnO was coated by sedimentation on a copper-made substrate 2 in water-glass aqueous solution and dried sufficiently to form powder layer (luminescent unit) 3 on the substrate 2. For producing a luminescent device 1D, lattice-like grooves 4 were made in the powder layer 3 at an interval of 1 mm with a sharp-edged tool such as a pincette. In addition, as FIGS. 11(A) and 11(B), phosphor powder ZnO was coated by sedimentation on a substrate 1 in water-glass aqueous solution and dried sufficiently to form powder layer (luminescent unit) 3 on the substrate 2, thereby producing a luminescent device 101D with conventional fabrication.

The luminescent intensity under the bombardment of electron beam current was measured for these luminescent device 1D and 101D, through the use of the experimental equipment 50 shown in FIG. 3. The results are shown in FIG. 8.

Figure 8:
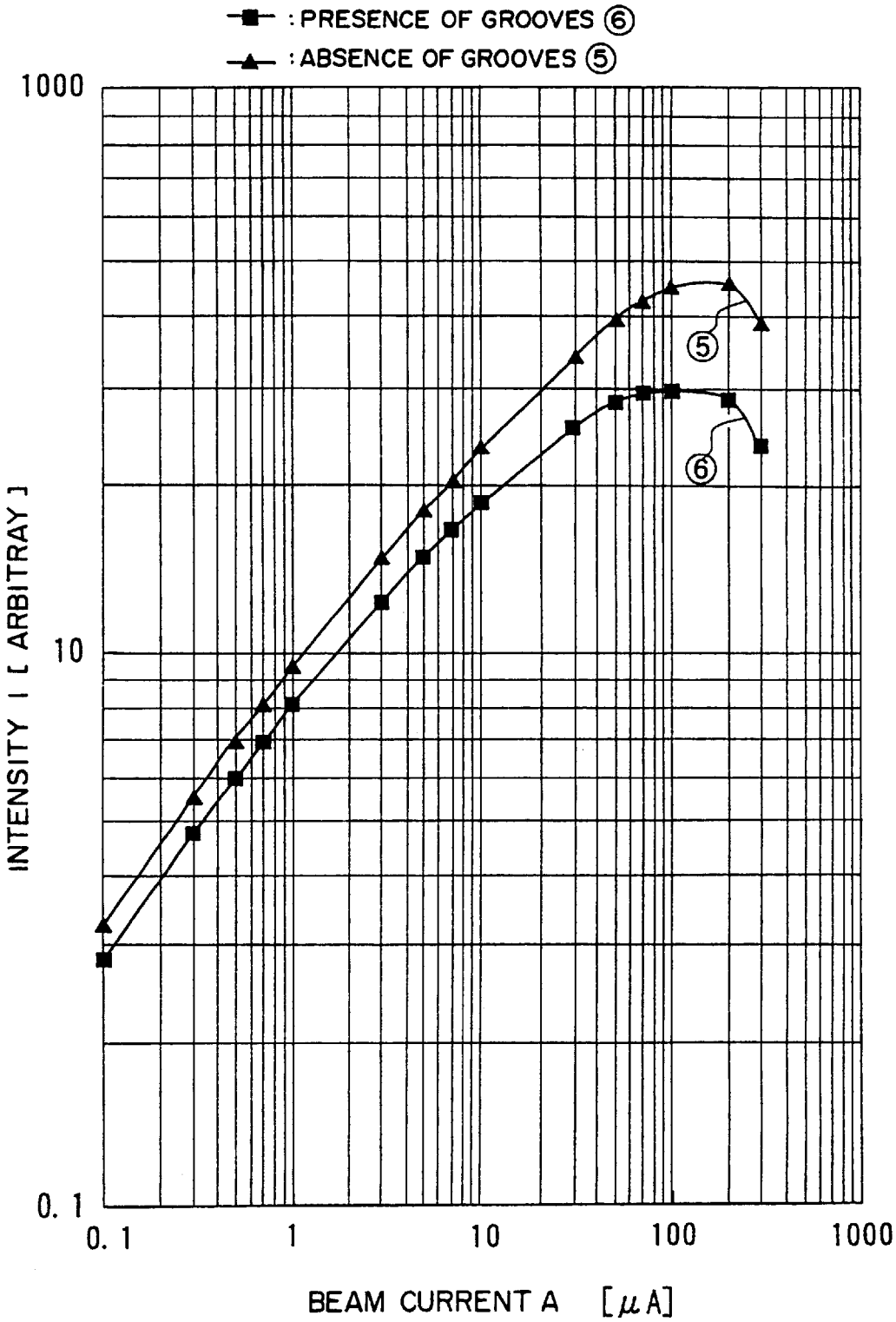
FIG. 8 is an illustration of measurement results of an experiment on the current dependency of luminescent intensity in a luminescent device of a comparative example in contrast with the present invention.

In the log-log graph of FIG. 8, the vertical axis represents luminescent intensity I of the luminescent device and the horizontal axis denotes beam current A supplied to the electron gun 52. In the illustrations, circled numeral 6 is for the luminescent device 1D (having grooves) and circled numeral 5 is for the luminescent device 101D (without grooves).

As obvious from FIG. 8, the luminescent intensity I showed a maximum value in the vicinity of beam current A of 100 $\mu$A, and the luminescent intensity I decreased beyond the beam current A. This was irrespective of the presence (the luminescent device 1D) or absence (luminescent device 101D) of grooves. In case the luminescent unit was fabricated with an electrical conductive phosphor, the luminescent intensity I thus did not increase superlinearly even if the beam current A increased beyond a threshold. The effect of the grooves 4 was not obtained.

It can be understood that this is because the powder (phosphor) itself has electrical conductive property to acquire less electrification property even if the grooves 4 are made in the luminescent unit 3 so that the luminescent unit 3 has minute uneven surface for facilitating the storage of electric charge. This supported the inventors' concept that the electrification property of the luminescent unit 3 is related to the above-mentioned phenomenon (the phenomenon that the luminescent intensity I increases superlinearly with the beam current A above a threshold, as observed in the three examples).

(E) First Application Example

Figure 9:
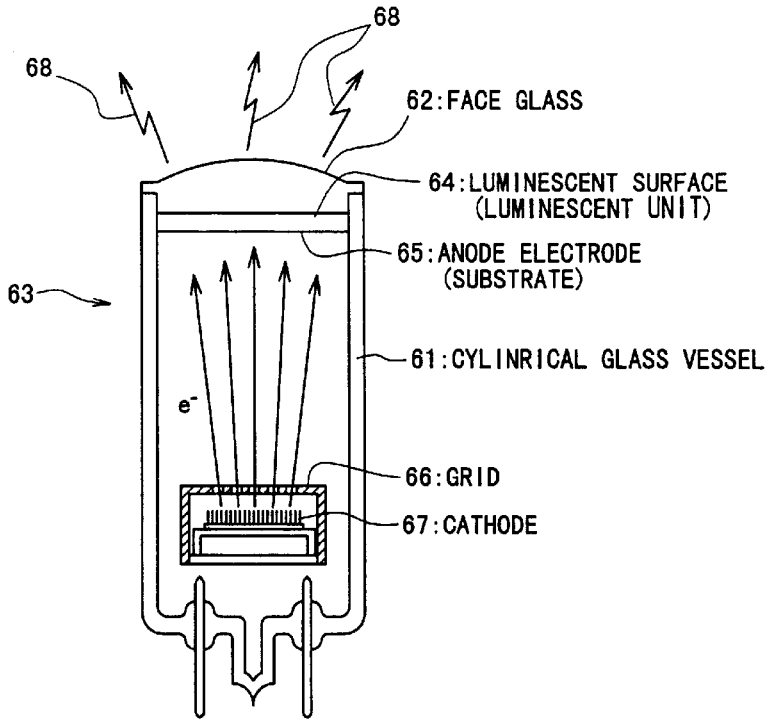
FIG. 9 is an illustrative view showing a configuration of an image tube (illuminator) using a luminescent device (structured lighting material) as the first application example of the present invention.

Referring to the drawings, a description will be given hereinbelow of an application example in which a structured lighting material according to the present invention is incorporated into an image tube forming a luminescent display (illuminator). FIG. 9 is an illustrative view showing a configuration of the image tube as the first application example of the structured lighting material according to the present invention.

As FIG. 9 shows, a face glass 62 is fixedly adhered onto a cylindrical glass vessel 61 to produce a vacuum vessel (envelop) 63 in this image tube. In addition, in the interior of the vacuum vessel (envelope) 63, there are a luminescent surface (luminescent unit) 64, an anode electrode (substrate) 65 and a cathode forming a electron discharge unit (a grid 66, a cathode 67). A structured lighting material according to the present invention is applied to the aforesaid luminescent surface 64 and anode electrode 65.

In general, the anode electrode 65 is composed of a metallic electrode made of aluminum, copper or the like, or a metal plated electrode made of these metals. The cathode 67 of the electron discharge section is typically a conventional filament (for example, made by applying electron-emissive material like barium oxide/calcium oxide/strontium oxide to the tungsten filament), carbon nanotube or the like.

In this image tube, a voltage is applied to the grid 66 to establish a condition of electron discharge from the electrode 67. In addition, when a electric potential works on the anode electrode 65 and the electrons discharged from the cathode 67 are accelerated to collide against and penetrate the anode electrode 65, thereby making impact on the luminescent surface 64. As a result, the luminescent surface 64 is excited by the electron impact and luminescent color corresponding to the luminescent material forming the luminescent surface 64 passes through the face glass 62 and appears as luminescence 68 on the front side.

(F) Second Application Example

Referring to the drawings, a description will be given hereinbelow of an example of the application of a structured lighting material according to the present invention applied to a cathode-ray luminescent lamp. FIG. 10 is an illustrative view showing a configuration of a cathode-ray luminescent lamp as the second example of the application of a structured lighting material according to the present invention.

Figure 10A:
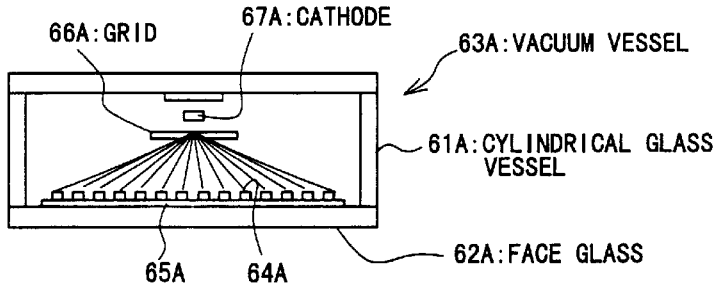
FIGS. 10(A) and 10(B) are illustrations of a configuration of a cathode-ray lamp (illuminator) using a luminescent device (structured lighting material) as the second application example of the present invention.
Figure 10B:
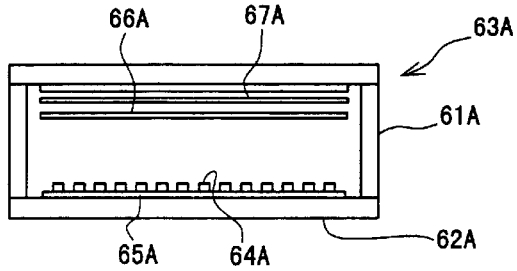

As FIGS. 10(A) and 10(B) show, in this cathode-ray luminescent lamp, a vacuum vessel (envelope) 63A is composed of a cylindrical glass vessel 61A and a face glass 62A. In addition, in the interior of the vacuum vessel (envelope) 63A, there are a luminescent surface (luminescent unit) 64A, an anode electrode (substrate) 65A and a cathode forming a electron discharge section (a grid 66A, a cathode 67A). A structured lighting material according to the present invention is incorporated into the aforesaid luminescent surface 64A and anode electrode 65A.

In general, the anode electrode 65A is composed of a metallic electrode made of aluminum, copper or the like, or a metal plated electrode made of these metals. The cathode 67A of the electron discharge section is typically a conventional filament (for example, made by applying electron-emissive material like barium oxide/calcium oxide/strontium oxide to a tungsten filament), a carbon nanotube or the like.

In this cathode-ray luminescent lamp, a voltage is applied to the grid 66A to make a condition of electron discharge from the electrode 67A. In addition, when a electric potential works on the anode electrode 65A and the electrons discharged from the cathode 67A are accelerated toward the anode electrode 65A to collide against the luminescent surface 64A so that an impact takes place thereon. As a result, the luminescent surface 64A is excited by the electron impact and luminescent color corresponding to the luminescent material forming the luminescent surface 64A passes through the face glass 62A and luminescence takes place toward the front side.

As mentioned above, in the first and second application examples, the luminescent surfaces 64 and 64A are made up of the structured lighting material with an uneven surface of luminescent unit. Thus, according to the above-mentioned application examples, the configuration of the structured lighting material, specifically the formation of the minute uneven surface of the luminescent unit (coated layer), realizes a high-efficient illuminator such as an image tube or a cathode-ray luminescent lamp.

In this connection, although the above-mentioned application examples relate to the image tube and the cathode-ray luminescent lamp, the present invention covers all changes and modifications of the application examples which do not deviate from the spirit and scope of the invention. For example, in the image tube according to the first application example shown in FIG. 9, it is also possible that the anode electrode 65 and the luminescent surface 64 are reversed in positional relationship so that the direction of the luminescence is toward the cathode side. It is also acceptable to construct it without the grid 66.

What is claimed is:

1. A structured lighting material comprising a luminescent unit wherein said luminescent unit shows a non-electrical conductive property and has a minute uneven surface, and the incoherent luminescence intensity of said luminescent unit increases superlinearly when energy applied to said minute uneven surface in a non-contact manner exceeds a threshold.

2. A structured lighting material according to claim 1, wherein the luminescent color of said luminescent unit changes when said energy exceeds said threshold.

3. A structured lighting material according to claim 1, wherein said energy is electric energy originating from any one of electron beam, electric charge and electric field.

4. A method to generate incoherent luminescence, comprising:

providing a structured lighting material including:

a luminescent unit wherein said luminescent unit shows a non-electrical conductive property and has a minute uneven surface, and the incoherent luminescence intensity of said luminescent unit increases superlinearly when energy applied to said minute uneven surface in a non-contact manner exceeds a threshold; and applying energy exceeds the threshold to said luminescent unit in the non-contact manner.

5. A structured lighting material according to claim 1, wherein said luminescent unit comprises a single phospohor.

6. A structured lighting material according to claim 1, wherein said minute uneven surface is formed in a manner that said luminescent unit is formed to be non-uniform in thickness.

7. A structured lighting material according to claim 6, wherein said minute uneven surface has high and low portions respectively corresponding to maximum and minimum thicknesses of said luminescent unit, and said maximum thickness is set to be three or more times said minimum thickness.

8. A structured lighting material according to claim 6, wherein said minute uneven surface has high and low portions respectively corresponding to maximum and minimum thicknesses of said luminescent unit, and said maximum thickness is set to be ten or more times said minimum thickness.

9. A structured lighting material according to claim 6, wherein said minimum thickness of said luminescent unit is not more than 500 $\mu$m.

10. A structured lighting material according to claim 6, wherein said minimum thickness of said luminescent unit is not more than 50 $\mu$m.

11. A structured lighting material according to claim 6, wherein an inclination angle of the minute uneven surface is in a range from 30 degrees to 150 degrees.

12. A structured lighting material according to claim 6, wherein an inclination angle of the minute uneven surface is in a range from 50 degrees to 150 degrees.

13. A structured lighting material according to claim 1, wherein said luminescent unit is made of inorganic material.

14. A structured lighting material according to claim 1, wherein said luminescent unit is adhered on a substrate.

15. A structured lighting material according to claim 14, wherein said luminescent unit is adhered on said substrate without water-soluble fixing agent.

16. A structured lighting material according to claim 15, wherein said luminescent unit is adhered on said substrate in a manner of facilitating electrification.

17. An illuminator using said structured lighting material defined in claim 1.

* * * * *